US006528010B2

(12) United States Patent
Zacharias et al.

(10) Patent No.: US 6,528,010 B2
(45) Date of Patent: Mar. 4, 2003

(54) MOLTEN METAL HANDLING VESSEL

(75) Inventors: Donald R. Zacharias, Parma, OH (US); Norbert A. Strobel, Hamilton (CA)

(73) Assignees: Foseco International Limited, Wiltshire (GB); Stelco Inc., Hamilton (CA)

( * ) Notice: Subject to any disclaimer, the term of this patent is extended or adjusted under 35 U.S.C. 154(b) by 0 days.

(21) Appl. No.: 09/778,038

(22) Filed: Feb. 7, 2001

(65) Prior Publication Data

US 2001/0045692 A1 Nov. 29, 2001

Related U.S. Application Data

(60) Provisional application No. 60/181,085, filed on Feb. 8, 2000.

(51) Int. Cl.[7] ..... C21B 3/00
(52) U.S. Cl. ..... 266/275; 164/337
(58) Field of Search ..... 266/236, 275; 164/335, 337, 435, 437

(56) References Cited

U.S. PATENT DOCUMENTS 3,200,457 A * 8/1965 Wagstaff ..... 266/275
3,408,059 A * 10/1968 Hornak ..... 164/437
3,635,459 A 1/1972 Mare
3,695,604 A 10/1972 Stein
4,098,321 A * 7/1978 Wilson et al. ..... 164/437
4,202,538 A * 5/1980 Shamada et al. ..... 266/275
4,216,944 A 8/1980 Shimada et al.
4,746,102 A * 5/1988 Gilles et al. ..... 266/275
4,886,247 A * 12/1989 Hoffman et al. ..... 266/275
5,948,349 A 9/1999 Beurotte et al.

FOREIGN PATENT DOCUMENTS

EP 0 729 800 A1 2/1996

* cited by examiner

*Primary Examiner*—Scott Kastler
(74) *Attorney, Agent, or Firm*—Nixon & Vanderhye

(57) ABSTRACT

A molten metal handling vessel, comprising a base and one or more sidewalls surrounding the base and extending upwardly therefrom, the interior surfaces of the base and sidewall(s) each comprising a lining formed from refractory material, the sidewall lining including a ledge spaced a distance from the base lining, the ledge projecting inwardly into the interior of the vessel and extending around at least a quarter of the periphery of the base, and all parts of the sidewall lining below the ledge projecting at least as far into the vessel as does the ledge.

13 Claims, 6 Drawing Sheets

MOLTEN METAL HANDLING VESSEL

This application claims the benefit of U.S. Provisional Application No. 60/181,085, filed Feb. 8, 2000, the entire content of which is hereby incorporated by reference in this application.

The present invention relates to molten metal handing vessels, and in particular to refractory linings for such vessels, to articles for forming such linings, and to methods of forming such linings.

Molten metal handling vessels to which the invention is applicable include tundishes and ladles. The invention has particular utility for tundishes used in the continuous casting of steel.

In the continuous casting of metals, e.g. steel, molten metal is poured from a ladle into a continuous casting mould via an intermediate vessel, known as a tundish, which acts as a constant head reservoir. The tundish has a metal base and sidewalls and one or more outlet nozzles, normally in the base. The base and sidewalls, in the interior of the tundish, each have a lining formed from refractory material which is able to withstand prolonged contact with the molten metal during use. The base and sidewall linings may be formed from refractory bricks and/or refractory boards, or they may be formed from a preformed monolithic lining, example. Additionally or alternatively, the linings may be formed in situ in the tundish by casting the refractory material between a former and the base and sidewalls, or by ramming, trowelling or spraying the refractory material in place.

During use, a tundish normally contains a substantially constant level of molten metal, with the rate of inflow of molten metal equalling the rate of outflow. At the end of a continuous casting cycle, the volume of molten metal in the tundish is allowed to decrease. The tundish is not allowed to empty all of its metal into the continuous casting moulds however, because this would cause contamination of the cast metal with flux and slag floating at the surface of the metal in the tundish. At the end of a casting cycle, the tundish therefore contains leftover metal, known as skull. The skull is normally allowed to solidify in the tundish and typically is removed by rotating the tundish so that the skulls falls out. The removal of the skull may be assisted by the use of a hydraulic ram to push the skull out of the tundish; this is generally a time-consuming process. At times, even this procedure is unsuccessful, and a machine must be used to break away material which is holding the skull in the tundish. This is a very time-consuming process and often results in damage to the refractory lining of the tundish which must be repaired before the tundish can be used again. It will be appreciated that it would be desirable to reduce the amount of skull in a tundish, since skull is effectively wasted yield. It would also be desirable to make the removal of skull easier and less damaging to the tundish, since at present skull removal can be a difficult and time-consuming procedure.

According to a first aspect, the present invention provides a molten metal handling vessel, for example a tundish, comprising a base and one or more sidewalls surrounding the base and extending upwardly therefrom, the interior surfaces of the base and sidewall(s) each comprising a lining formed from refractory material, the sidewall lining including a ledge spaced a distance from the base lining, the ledge projecting inwardly into the interior of the vessel and extending around at least a quarter of the periphery of the base, and all parts of the sidewall lining below the ledge projecting at least as far into the vessel as does the ledge.

The invention has several advantages. Firstly, because the ledge, and all parts of the sidewall lining below the ledge, project further into the vessel than do those parts of the lining above the ledge, the horizontal cross-sectional area of the region of the vessel below the ledge is smaller than that above the ledge. This means that, for a particular height of skull remaining in the vessel, the volume of the skull is reduced. This is important because there will generally be a minimum safe height of the surface of the molten metal above the outlet or outlets of the vessel below which it will be deemed unsafe to allow the metal to fall. This is because of the necessity of ensuring that no flux or slag escapes from the tundish (for example) into the casting mould or moulds. The minimum safe height of the molten metal above the or each outlet is normally significant, since below a particular height (which will vary from vessel to vessel) a vortex may be created in the molten metal as it flows through the outlet, and this may drag slag or flux from the surface of the metal down through the outlet.

Secondly, because the invention provides the possibility of decreased amounts of skull remaining in the vessel at the ends of casting cycles, it also provides the possibility of quicker grade changes between continuous casting ladle batches. In the continuous casting process, once a particular batch of metal has been cast, i.e. once a particular ladle of metal has been emptied, another ladle filled with molten metal is normally put in its place and the metal from this ladle is poured into the tundish. Because there inevitably is variation between batches of metal, or indeed because different metal compositions need to be cast, there is a transition period in which the metal being cast varies in composition until a uniform composition in the tundish is achieved. By reducing the amount of left-over metal (i.e. skull) in the tundish between ladle changes, the amount of transitional metal (which is variable in composition and hence limited in usefulness and less valuable) is also reduced, thereby increasing the productivity of metal which has a consistent composition.

Thirdly, because the sidewall lining of the vessel includes an inwardly projecting ledge spaced a distance from the base lining and extending around at least a quarter of the periphery of the base, and because all parts of the sidewall lining below the ledge project at least as far into the vessel as does the ledge, this means that, if skull left in the vessel has a depth greater than the height of the ledge above the base lining, when the skull solidifies, an upper outer portion of the solid skull will be trapped or retained above the ledge. Because the skull generally solidifies as a single mass. and furthermore because metal shrinks as it cools, the skull which solidifies in the vessel will generally be pulled away and separated from the base lining of the vessel by the skull trapped above the ledge, thereby making removal of the skull quicker and easier than in conventional tundishes or other conventional molten metal handling vessels.

Fourthly, for embodiments of the invention in which the ledge and the sidewall lining below the ledge are formed by making the lining thicker in these regions, the invention has the advantage that because the lining is thicker in these regions, and because these regions normally experience the greatest rate of erosion, the provision of thicker lining in these regions may extend the service life of the entire lining. Furthermore, in conventional vessels which do not have such thicker lining regions, erosion often results in the formation of an undercut, which can contribute to skull sticking in the vessel. The provision of thicker lining regions may reduce or eliminate this problem.

The ledge preferably extends around at least a third of the periphery of the base, more preferably around at least a half of the periphery of the base, even more preferably around at least two thirds of the periphery of the base, especially around at least three quarters of the periphery of the base. Most preferably, however, the ledge extends around substantially the entire periphery of the base. In some embodiments of the invention, however, the ledge may not extend around the entire periphery of the base, i.e. it may contain a gap, in order to accommodate one or more flow control articles in the vessel, e.g. an impact pad (such as an impact pad sold under the trademark TURBOSTOP by Foseco) or a dam or baffle, or other flow control device.

In some embodiments of the invention, the surface of the ledge may be substantially parallel to the refractory lining of the base. It is presently preferred, however, for the surface of the ledge to be inclined with respect to the refractory lining of the base. Preferably the ledge surface is inclined downwardly towards the base lining, in a direction towards the interior of the vessel. The ledge surface is preferably inclined at an angle of between 15° and 75° to horizontal (or to the base lining), more preferably between 400 and 65°.

It is common for the open top of a tundish to be wider than the interior base of the tundish. The sidewall lining is therefore usually inclined with respect to vertical, extending inwardly in a direction towards the base of the tundish. In the present invention, therefore, the part of the tundish lining below the ledge is preferably inclined with respect to vertical, extending inwardly in a direction towards the base of the tundish. In some preferred embodiments of the invention, therefore, the part of the sidewall lining below the ledge is inclined to the vertical (inwardly and downwardly) at an equal or greater angle than is the part of the sidewall above the ledge.

It is generally preferred for substantially the entire length of the ledge to be spaced a substantially constant distance from the base lining, i.e. the surface of the ledge is preferably a substantially constant height above the base lining along the length of the ledge. When the vessel is a tundish, for example, the base lining will normally be flat and substantially horizontal during use, and it is preferred for substantially the entire length of the ledge to be arranged to be substantially horizontal during use (i.e. during the operation of the tundish, and preferably also during solidification of skull).

The distance by which the ledge surface is spaced from the base lining will vary from vessel to vessel. The optimum height of the ledge will normally be a compromise between making the ledge high so as to be able to reduce the amount of skull to a minimum while ensuring that vortex formation above the outlet(s) does not occur, and making the ledge low so as to maximize the overall working volume of the vessel (for example for ladle changes). The safe minimum height of the metal for avoiding vortex formation, and the overall working volume, will vary from vessel to vessel depending upon the geometry of the vessel and its flow characteristics, and therefore the optimum height of the ledge will be determined in each case by trial and error.

According to a second aspect, the invention provides one or more articles formed from refractory material for forming at least part of at least the sidewall lining (but preferably also the base lining) of a vessel according to the first aspect of the invention, the article including a ledge portion adapted to form at least part of the ledge of the vessel. The or each article may be, for example, a brick of refractory material (to be used in conjunction with other bricks to form the lining) or it may be a board of refractory material (to be used in conjunction with other boards to form the lining).

A third aspect of the invention provides a method of forming a vessel according to the first aspect of the invention, the method comprising providing at least one former and casting at least part of at least the sidewall lining between the sidewall(s) and the former from refractory material, the former being shaped such that the cast sidewall lining includes the ledge.

A fourth aspect of the invention provides a method of forming a vessel according to the first aspect of the invention, comprising forming the ledge by ramming, trowelling or spraying the refractory material onto at least part of at least the sidewall.

The refractory material of the base and sidewall linings may be any refractory material suitable for lining molten metal handling vessels. Persons skilled in the art of refractory linings will be able to select appropriate refractory compositions for each particular situation.

BRIEF DESCRIPTION OF THE DRAWINGS

The invention will now be described, by way of example, with reference to the accompanying drawings, of which:

FIG. 1 shows, in longitudinal cross-section, a conventional tundish 1 comprising a base 3, sidewalls 5 extending upwardly from the base and surrounding it, and an outlet 7 in the base. The interior surfaces 9 of the base and sidewalls each comprise a lining 11 formed from refractory material, and the exterior surfaces 13 are formed from a steel shell. The linings actually comprise two layers, namely an insulating board layer 11*a* adjacent to the steel shell, and an inner lining layer 11*b* formed from refractory bricks or formed as a monolithic lining. The monolithic lining has been formed in situ in the tundish, e.g. by being cast between a former and the insulating board layer 11*a* or by ramming, spraying or trowelling the refractory material to form the lining.

Figure 1:
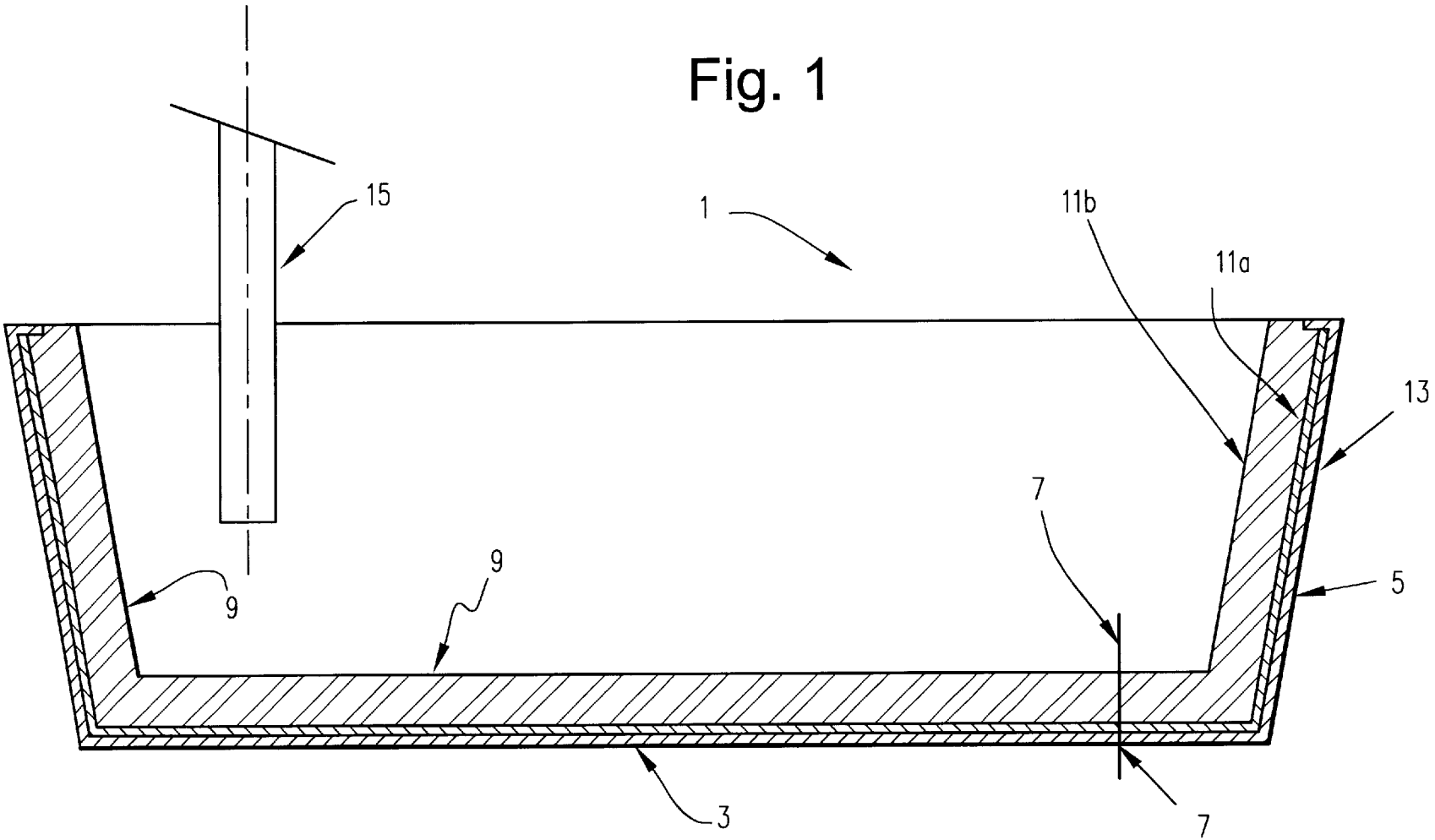
FIG. 1 shows a conventional tundish, in longitudinal cross-section.

Also shown in FIG. 1 is a ladle shroud 15, i.e. an outlet from a ladle (not shown) situated above the tundish in use. During the continuous casting process, the tundish contains molten metal (not shown) to a level above the bottom of the ladle shroud, i.e. the ladle shroud is partially submerged in the molten metal in the tundish.

Figure 2:
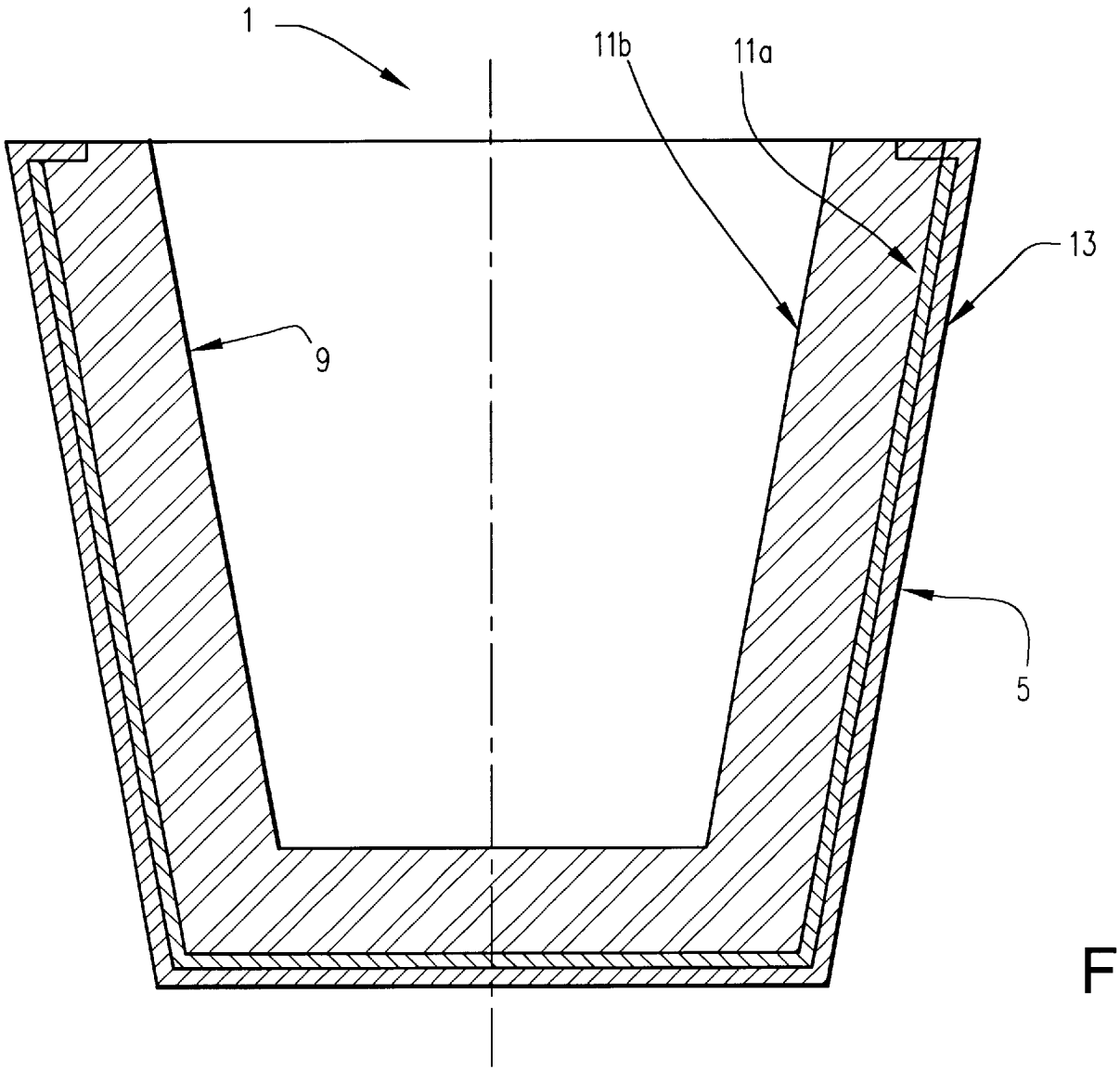
FIG. 2 shows the tundish of FIG. 1 in transverse cross-section.

FIG. 2 shows the tundish of FIG. 1 in transverse cross-section.

Figure 3:
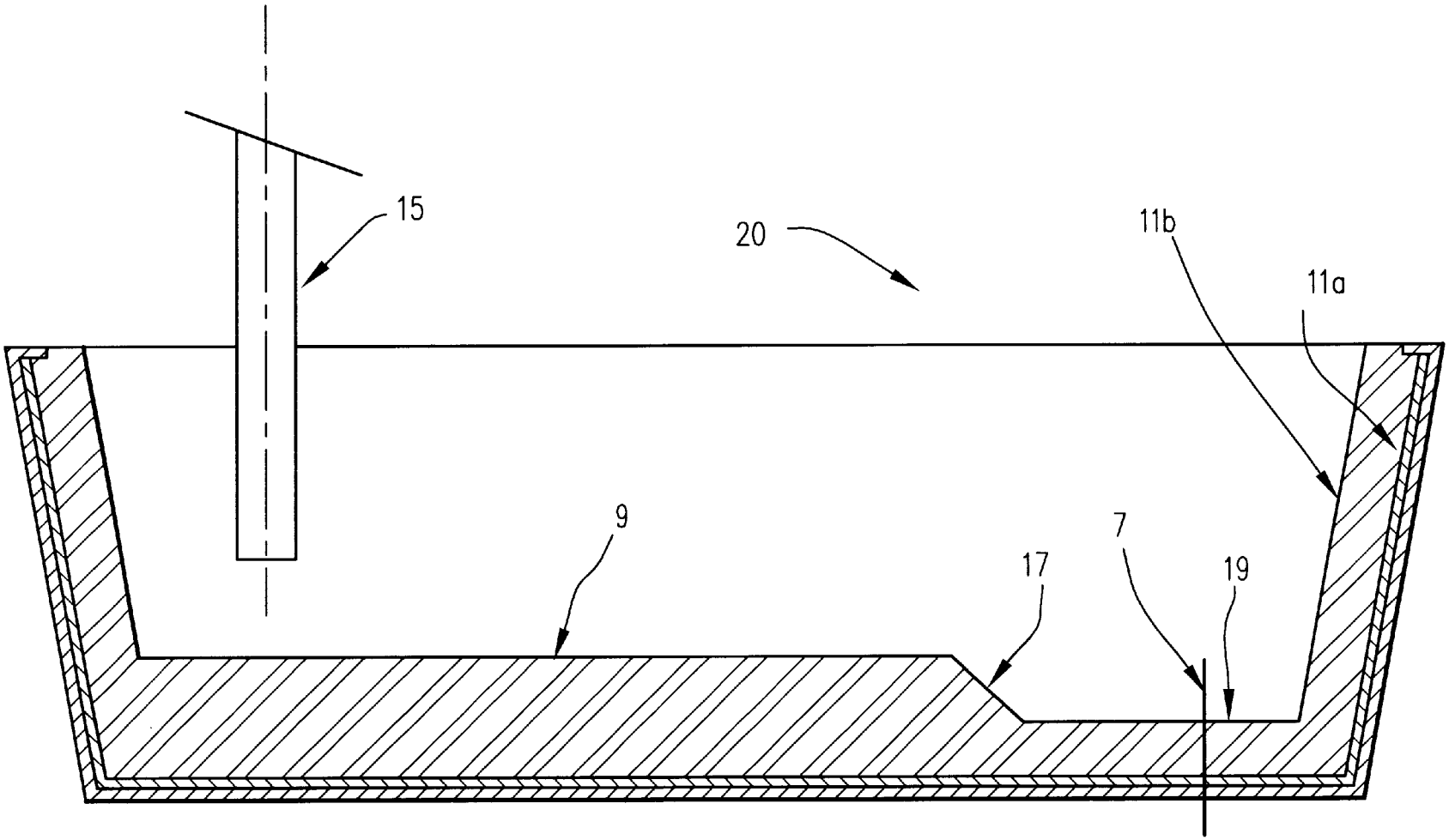
FIG. 3 shows an alternative conventional tundish, in longitudinal cross-section.

FIG. 3 shows an alternative conventional tundish 20 which is identical to that shown in FIG. 1, except that the base lining has a greater thickness other than in the region of the outlet, thereby forming a step 17 defining a well 19 in the base of the tundish around the outlet. This design ensures that the depth of molten metal above the outlet is maintained at a high enough level to prevent vortex formation (which can drag slag and flux down through the outlet) even when the overall level of molten metal in the tundish is reduced.

Figure 4:
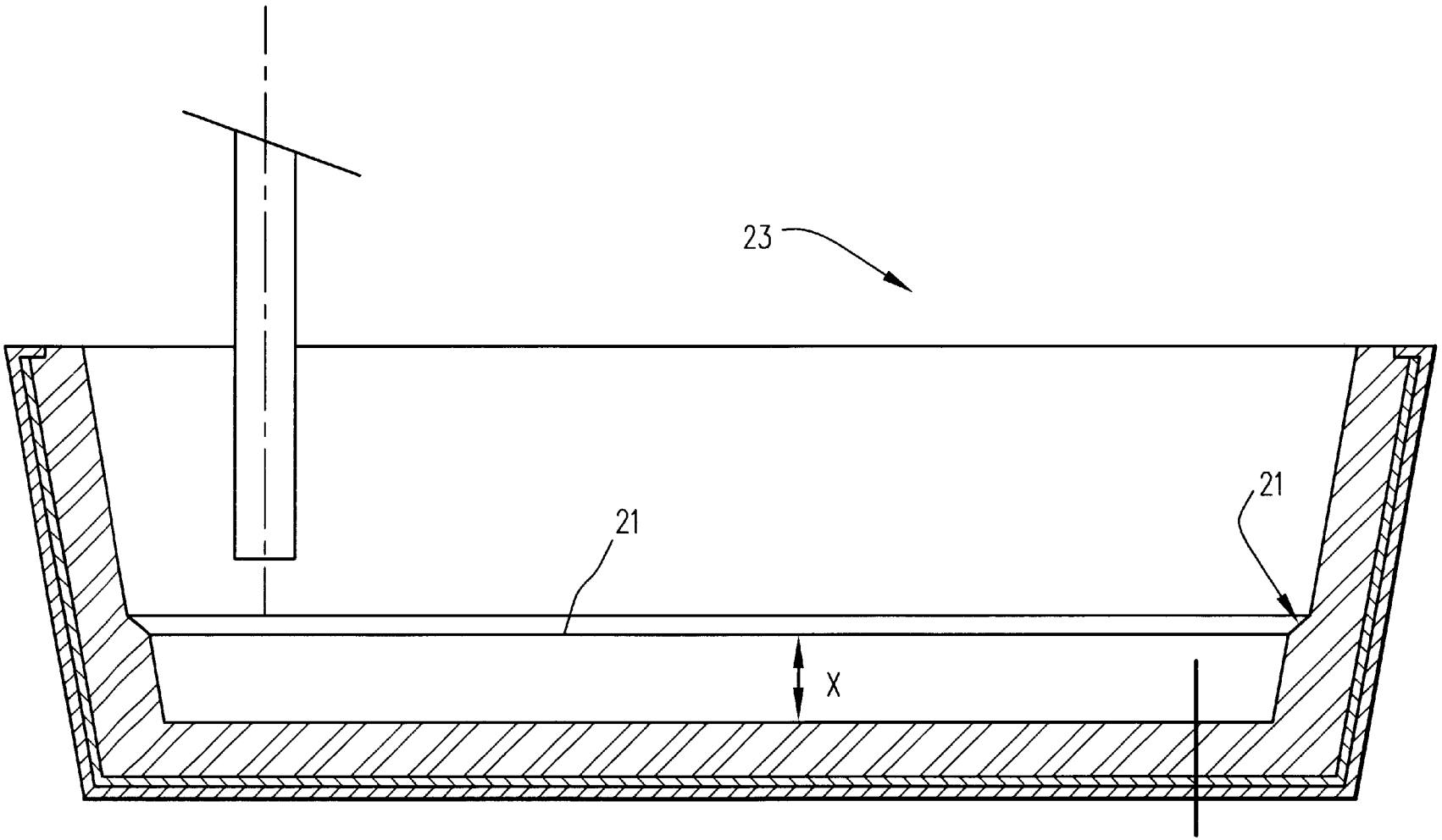
FIG. 4 shows a tundish according to the invention, in longitudinal cross-section.

FIG. 4 shows a tundish 23 in accordance with the invention, in longitudinal cross-section. The tundish is identical to that of FIG. 1, except that the sidewall lining 11 includes a ledge 21 spaced a distance x from the base lining, the ledge projecting inwardly into the interior of the vessel and extending around the periphery of the base. All parts of the sidewall lining below the ledge project at least as far into the vessel as does the ledge; in fact the outer steel shell and the sidewall lining are inclined inwardly towards the base of the tundish, and the part of the sidewall lining below the ledge is inclined at the same angle as the part of the sidewall lining above the ledge. The surface 21 of the ledge is inclined inwardly and downwardly at about 45° to the horizontal.

Figure 5:
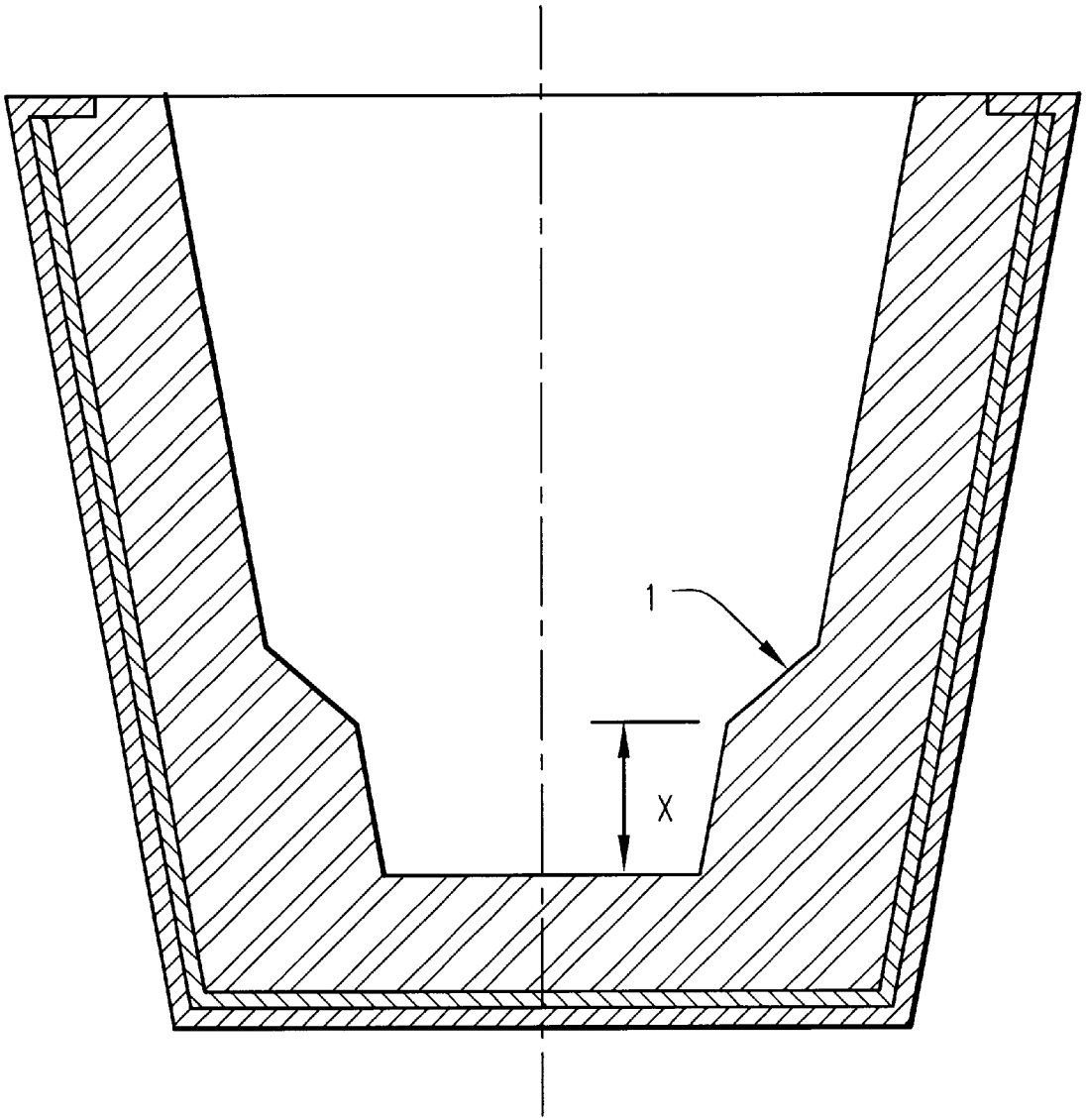
FIG. 5 shows the tundish of FIG. 4 in transverse cross-section.

FIG. 5 shows the tundish of FIG. 4 in transverse cross-section.

Figure 6:
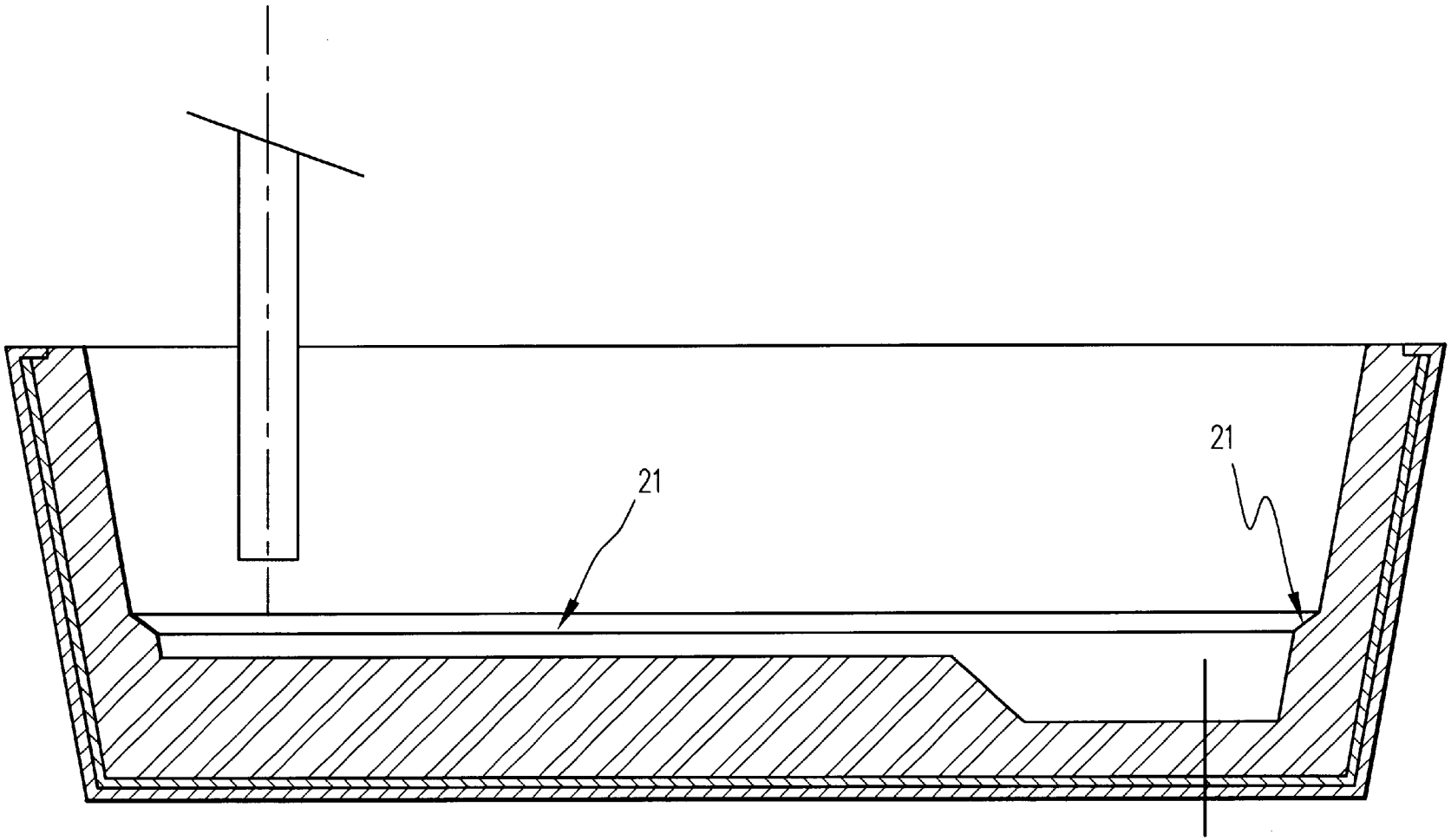
FIG. 6 shows an alternative tundish according to the invention, in longitudinal cross-section.

FIG. 6 shows, in longitudinal cross-section, an alternative tundish according to the invention. The tundish is identical to that of FIG. 3, except that the sidewall lining 11 includes a ledge 21 spaced a distance x from the base lining, the ledge projecting inwardly into the interior of the vessel and extending around the periphery of the base. All parts of the sidewall lining below the ledge project at least as far into the vessel as does the ledge.

We claim:

1. A tundish suitable for use in the production of steel and capable of deskulling by rotating the tundish and allowing the skull to fall out, comprising a base, an outlet in the base and one or more sidewalls surrounding the base and extending upwardly therefrom, the interior surfaces of the base and sidewall(s) each comprising a lining formed from refractory material, the sidewall lining including a ledge spaced a first distance from the base lining, the ledge projecting laterally inwardly a second distance into the interior of the tundish and extending around at least a quarter of the periphery of the base, and all parts of the sidewall lining below the ledge projecting at least as far into the tundish as does the ledge, said first distance being substantially greater than said second distance.

2. A tundish according to claim 1, in which the ledge extends around at least a third of the periphery of the base.

3. A tundish according to claim 1, in which the ledge extends around at least a half of the periphery of the base.

4. A tundish according to claim 1, in which the ledge extends around at least two thirds of the periphery of the base.

5. A tundish according to claim 1, in which the ledge extends around at least three quarters of the periphery of the base.

6. A tundish according to claim 1, in which the ledge extends around substantially the entire periphery of the base.

7. A tundish according to claim 1, in which the ledge is substantially parallel to the refractory lining of the base.

8. A tundish according to claim 1, in which the surface of the ledge is inclined with respect to the refractory lining of the base.

9. A tundish according to claim 8, in which the surface of the ledge is inclined downwardly towards the base lining, in a direction towards the interior of the tundish.

10. A tundish according to claim 1, in which substantially the entire length of the ledge is spaced a substantially constant distance from the base lining.

11. A tundish according to claim 1, in which substantially the entire length of the ledge is arranged to be substantially horizontal during use.

12. A method of forming a tundish according to claim 1, comprising providing at least one former and casting at least part of at least the sidewall lining between the sidewall(s) and the former from refractory material, the former being shaped such that the cast sidewall lining includes the ledge.

13. A method of forming a tundish according to claim 1, comprising forming the ledge by ramming, trowelling or spraying the refractory material onto at least part of at least the sidewall.

* * * * *